US006663317B1

(12) United States Patent
Williams et al.

(10) Patent No.: US 6,663,317 B1
(45) Date of Patent: Dec. 16, 2003

(54) DRAINAGE CHANNEL

(75) Inventors: Barry Clifton Williams, Statesville, NC (US); Timothy Harold Wallace, Charlotte, NC (US)

(73) Assignee: ABT, Inc., Troutman, NC (US)

( * ) Notice: Subject to any disclaimer, the term of this patent is extended or adjusted under 35 U.S.C. 154(b) by 0 days.

(21) Appl. No.: 10/190,839

(22) Filed: Jul. 8, 2002

(51) Int. Cl.[7] ..... E02B 13/00; E02B 5/00
(52) U.S. Cl. ..... 405/48; 404/3; 52/11
(58) Field of Search ..... 405/43, 47, 48, 405/118, 119; 404/2–4; 52/11, 15

(56) References Cited

U.S. PATENT DOCUMENTS

| | | | | |
|---|---|---|---|---|
| 1,858,101 A | | 5/1932 | McAfee | 248/49 |
| 2,187,119 A | | 1/1940 | Fish | 285/5 |
| 2,386,020 A | | 10/1945 | Wendelken | 404/2 |
| 2,727,294 A | | 12/1955 | Arrighini | 249/7 |
| 3,026,076 A | | 3/1962 | Bender | 248/49 |
| 3,465,654 A | | 9/1969 | Fox | 404/4 |
| 3,722,849 A | | 3/1973 | Luyben | 249/219.2 |
| 3,855,799 A | * | 12/1974 | Martin et al. | 405/49 |
| 3,876,322 A | | 4/1975 | Deason | 404/2 |
| 4,020,639 A | | 5/1977 | Nagare et al. | 405/36 |
| 4,182,581 A | * | 1/1980 | Uehara et al. | 405/43 |
| 4,312,504 A | | 1/1982 | Rutledge et al. | 472/92 |
| 4,365,911 A | | 12/1982 | Rossberg | 405/43 |
| 4,490,067 A | | 12/1984 | Dahowski | 404/4 |
| 4,560,302 A | | 12/1985 | Karbstein | 404/4 |
| 4,787,773 A | | 11/1988 | Kehler | 405/118 |
| 4,815,888 A | | 3/1989 | Stegmeier | 404/4 |
| 4,838,727 A | | 6/1989 | Capuano | 404/2 |
| 4,844,655 A | | 7/1989 | Aleshire | 405/118 |
| 5,135,331 A | | 8/1992 | Steiner | 404/2 |
| 5,181,793 A | | 1/1993 | Dekel | 404/4 |
| 5,340,234 A | | 8/1994 | Rossi et al. | 405/48 |
| 5,380,121 A | | 1/1995 | Schluter | 404/14 |
| 5,454,663 A | | 10/1995 | Stegmeier | 404/2 |
| 5,501,547 A | | 3/1996 | Mantelli | 405/121 |
| 5,538,361 A | | 7/1996 | Beamer | 405/118 |
| 5,564,857 A | | 10/1996 | Schluter | 405/36 |
| 5,568,995 A | | 10/1996 | Beamer | 405/119 |
| 5,573,351 A | | 11/1996 | Beamer | 405/119 |
| 5,613,804 A | | 3/1997 | Beamer | 405/119 |
| 5,702,204 A | | 12/1997 | Gunter | 405/119 |
| 5,853,265 A | | 12/1998 | Gunter | 405/118 |
| 5,871,306 A | | 2/1999 | Tilcox | 405/157 |
| 5,890,839 A | | 4/1999 | Gunter | 405/119 |
| 5,908,266 A | | 6/1999 | Miller | 405/41 |
| 6,000,881 A | | 12/1999 | Becker et al. | 405/119 |
| 6,113,311 A | | 9/2000 | Becker et al. | 405/119 |
| 6,220,784 B1 | | 4/2001 | Bricker | 405/118 |
| 6,234,447 B1 | | 5/2001 | Boyden et al. | 249/34 |
| 2001/0027978 A1 | * | 10/2001 | Finlay et al. | 220/669 |

FOREIGN PATENT DOCUMENTS

| | | |
|---|---|---|
| EP | 0 167 384 A3 | 1/1986 |
| GB | 2 192 655 A | 1/1988 |

* cited by examiner

*Primary Examiner*—Robert E. Pezzuto
*Assistant Examiner*—Tara L. Mayo
(74) *Attorney, Agent, or Firm*—Alston & Bird LLP

(57) ABSTRACT

A drainage channel includes a conduit defining a lengthwise extending opening and an inlet defining a passageway in fluid communication with the opening. The inlet may have an exterior surface that defines a plurality of pockets spaced apart in the lengthwise direction. Concrete or another hardenable composition may fill these pockets to secure the inlet in position. The drainage channel may also include at least one saddle for supporting the conduit and an engagement member for preventing relative rotation between the conduit and the saddle. The saddle may extend about a majority of the conduit. In this regard, the saddle may include a base and a pair of upstanding arms extending outwardly therefrom. The arms are disposed on opposite sides of the conduit and converge thereabout so as to engage the conduit and prevent the conduit from floating as concrete or another hardenable composition is poured thereabout.

32 Claims, 5 Drawing Sheets

DRAINAGE CHANNEL

BACKGROUND OF THE INVENTION

The present invention relates generally to drainage channels and, more particularly, to drainage channels that include a preformed conduit for collecting and transporting water or other fluids.

Drainage channels of various sizes and shapes are desirable for numerous applications. For example, roadways, parking lots, airport runways, swimming pools and other paved and tiled surfaces typically require drainage systems which include drainage channels to collect and direct rainwater and other fluids to underwater storm sewers or the like, thereby preventing pooling upon the paved surface and decreasing runoff. Drainage channels may also be utilized in conjunction with various athletic surfaces such as polymeric running tracks or soccer fields formed of artificial turf or the like. In these instances, the drainage channels again collect rainwater and other fluids to reduce pooling and to minimize runoff. Some manufacturing facilities may also require drainage systems which include drainage channels formed in the building floors to collect, remove and/or recycle excess water or other liquids.

One conventional type of drainage channel includes a number of precast drainage channel sections. These precast drainage channel sections are positioned in a ditch or trench that has been-previously formed in the ground. In order to properly align the drainage channel sections, supports, such as brick pavers, are generally positioned at predetermined locations within the ditch. The brick pavers are typically spaced apart by a distance equal to the length of the drainage channel sections such that each brick paver may support the mated ends of a pair of drainage channel sections. In order to secure the brick pavers in position within the ditch, a subslab or footer of concrete or the like is generally poured about the brick pavers. Thereafter, the drainage channel sections are positioned upon the brick pavers. A hardenable composition, such as cement, concrete or the like, is then poured around the drainage channel sections and is allowed to set.

Once the hardenable composition has set, an elongate grate covering is generally placed across the otherwise open top of the drainage channel in order to prevent people from unwittingly stepping into the open trench, to provide a relatively smooth surface for vehicular traffic and/or to prevent relatively large objects from entering the trench and potentially blocking the flow of fluid therethrough. The grate is generally supported by a support surface defined longitudinally along an inner portion of each opposed sidewall of the drainage channel sections. Thus, the grate and the drainage channel generally have approximately the same width, such as four inches, five inches or six inches in many instances.

While a precast drainage channel having a relatively wide grate is advantageous for many applications, including those potentially requiring a large intake, some applications may require a drainage system that has a much smaller inlet in order to be less noticeable and/or to minimize the disruption of the surrounding surface. For example, drainage systems are commonly utilized to remove rainwater and the like from various types of athletic playing surfaces. In order to minimize the disruption of the athletic playing surface and to reduce, if not eliminate, any potential trip hazard, the inlet to the drainage channel is preferably quite small and typically has a width much smaller than that of the drainage channel itself. Moreover, some applications require that the drainage system be less expensive than conventional drainage systems that have a number of precast drainage channel sections.

In these applications, the drainage system generally includes a pipe or other conduit that is buried within the ground. The drainage system also includes an upstanding inlet mounted to the conduit and having an upper surface that is exposed so as to receive rainwater or other fluids. The inlet is in fluid communication with the conduit. In this regard, the conduit generally defines a lengthwise extending slit or opening with the inlet being seated within the opening. The inlet defines a number of passageways that open into the conduit. As such, rainwater and other fluids can pass through the passageways defined by the inlet and be collected within the conduit for transport to an underwater storm sewer or the like. Once installed, the drainage system may be buried such that only the upper surface of the inlet is exposed for receiving rainwater or other liquid runoff.

The inlet generally has a much smaller width than the conduit and, in some instances, may have a width of about two inches with passageways having widths of about a half inch. In contrast, the conduit may have a diameter of about four inches, five inches or more, depending upon the desired capacity of the conduit. While the reduced size of the inlet relative to the much wider grates that span precast drainage channels does limit the maximum rate at which the inlet can accept rainwater or other fluids, many applications do not require the drainage system to accept large quantities of liquid at any one time and are therefore more than satisfied by the capacity of drainage systems having smaller inlets.

Notwithstanding the advantages offered by drainage systems having smaller inlets including the reduced visibility of the drainage system and the reduced disruption in the surrounding surface created by the drainage system, conventional drainage systems having relatively small inlets still suffer from several disadvantages. For example, relatively large forces are sometimes placed upon the exposed upper surface of the inlet by passing vehicles or the like. As the magnitude of these downwardly directed forces increases, the inlet may actually be driven downwardly into the conduit, thereby necessitating relatively expensive and time consuming repairs.

At least partially in an attempt to reduce the likelihood that the inlet will be driven downwardly into the conduit, the inlet may be designed to have features that engage the concrete or other hardenable composition that is poured thereabout. As described by U.S. Pat. No. 4,365,911 to Shelton R. Rossberg, for example, the inlet may include a number of lengthwise extending, outwardly projecting ribs. Alternatively, the inlet may include a lengthwise extending, inwardly projecting groove or keyway to receive the concrete or other hardenable composition poured about the drainage channel. See U.S. Pat. No. 3,876,322 to Max W. Denson. In order to create an inwardly projecting groove of this type, material must generally either be removed from the sidewalls of the inlet to define the groove or the inwardly projecting groove must project further into the passageways defined by the inlet than would otherwise have been required in the absence of the groove. In instances in which material is effectively removed from the walls of the inlet, the overall strength and integrity of the inlet is somewhat compromised or reduced. Alternatively, in instances in which the inwardly extending groove projects into the passageways defined by the inlet, the passageways are somewhat restricted, thereby limiting the flow of fluid therethrough. As such, it would be desirable for an inlet to be engaged by the concrete or other hardenable composition that is poured thereabout in a manner that does not compromise the integrity or strength of the inlet and that does not block the passageways defined by the inlet through which fluid passes.

As with all drainage channels formed of a plurality of drainage channel sections, the drainage channel sections must be properly aligned in order to transport the fluid in the desired manner. As such, the adjoining end portions of adjacent drainage channel sections must be properly aligned with one another. The difficulties in properly aligning the drainage channel sections is further exacerbated in instances in which the conduit is cylindrical since the conduit may also rotate about its longitudinal axis. Since the inlets that are seated within the openings defined by the conduits should also be aligned, rotation of the conduits and the corresponding misalignment of the inlets is also disadvantageous. As such, it would be advantageous for a drainage system to include a mechanism for preventing relative rotation of the drainage channel sections, especially cylindrical conduit sections.

In addition, the conduit is generally formed of a relatively lightweight material, such as polyvinyl chloride (PVC). As such, the conduit may float upwardly as concrete or another hardenable composition is poured thereabout as a result of upwardly directed buoyant forces. Since the conduit is to be buried at a predetermined position, it would also be desirable to prevent flotation of the conduit as concrete or another hardenable composition is poured thereabout in order to insure proper positioning and burial of the conduit.

BRIEF SUMMARY OF THE INVENTION

A drainage channel is therefore provided that advantageously addresses these and other issues associated with conventional drainage systems. According to one aspect of the present invention, a drainage channel is provided having a conduit and an inlet that is designed to engage the concrete or other hardenable composition poured thereabout without significantly reducing the strength or integrity of the inlet and without obstructing the passageways defined by the inlet. According to another aspect of the present invention, a drainage channel is provided that includes at least one saddle for properly aligning the conduit and an engagement member for preventing relative rotation of the conduit with respect to the saddle. In addition to preventing relative rotation of the conduit, the saddle of this aspect of the present invention may also advantageously prevent the conduit from floating upwardly as concrete or another hardenable composition is poured thereabout.

The drainage channel includes a conduit defining a lengthwise extending opening, such as a pipe defining a lengthwise extending slit. The drainage channel also includes an inlet defining a passageway in fluid communication with the opening defined by the conduit. In this regard, the inlet typically engages the conduit and is seated within the opening. The conduit and the inlet have respective widths in the lateral direction, orthogonal to the lengthwise direction. Typically, the width of the inlet is smaller than the width of the conduit.

According to one advantageous aspect of the present invention, the inlet has an exterior surface that defines a plurality of pockets spaced apart in the lengthwise direction. As such, concrete or another hardenable composition may fill these pockets so as to secure the inlet in position. By filling these pockets, the concrete or other hardenable composition also serves to support at least some of the forces imposed upon the inlet by vehicular traffic or the like, thereby reducing the possibility that the drainage channel will be damaged by these forces.

The inlet may include a base and a body portion connected to the base. The base may be disposed within the conduit and the body portion may be disposed external to the conduit such that the inlet is effectively seated within the opening defined by the conduit. The body portion defines the plurality of pockets. In this regard, the body portion generally includes opposed upper and lower surfaces and a side surface extending therebetween. As such, the plurality of pockets typically open through at least one of the side and lower surfaces of the body portion and, in one embodiment, open through both the side and lower surfaces of the body portion.

In order to maintain the strength and integrity of the inlet, the relative size of the pockets may be somewhat limited. In this regard, the body portion has a height as defined between the upper and lower surfaces. As such, the plurality of pockets preferably extend from the lower surface of the body portion through no more than about 50% of the height of the body portion. The body portion also generally includes a pair of opposed side surfaces extending between the upper and lower surfaces and defining a width therebetween. As such, the plurality of pockets preferably extend inwardly from a respective side surface of the body portion to a depth that is less than 25% of the width of the body portion. Additionally, the plurality of pockets preferably have a collective length in the lengthwise direction that is less than 50% of the length of the conduit. As such, the plurality of pockets permit the concrete or other hardenable composition poured about the drainage channel to secure the inlet in position and to support at least some of the loads placed upon the upper surface of the inlet without compromising or significantly reducing the strength of the drainage channel.

According to another aspect of the present invention, the drainage channel includes a conduit, such as a pipe having a smooth or a corrugated exterior surface, at least one saddle for supporting the conduit and an engagement member for preventing relative rotation between the conduit and the at least one saddle. Typically, the conduit includes a plurality of conduit sections and the saddle is positioned to support end portions of two adjacent conduit sections.

At least one saddle extends about a majority of the conduit. In this regard, the saddle may include a base and a pair of upstanding arms extending outwardly from the base to respective distal ends. The upstanding arms are generally disposed on opposite sides of the conduit. Additionally, the distal ends of the arms preferably converge such that the opening defined between the distal ends of the arms is smaller than the opening defined between medial portions of the arms. By extending about a majority of the conduit and having distal ends that converge, the upstanding arms of the saddle engage the conduit and prevent the conduit from floating upwardly away from the saddle as concrete or another hardenable composition is poured thereabout. Since the saddle may be fixed in position within the trench or the like prior to pouring concrete or another hardenable composition about the conduit, the saddle retains the conduit in position within the trench or the like.

The engagement member may be a threaded member that extends through the saddle and into the conduit. To facilitate the insertion of the engagement member, the saddle may include a slot through which the engagement member is inserted. By engaging the saddle and the conduit, the engagement member prevents relative rotation of the conduit and, therefore, further maintains the desired alignment of the conduit.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
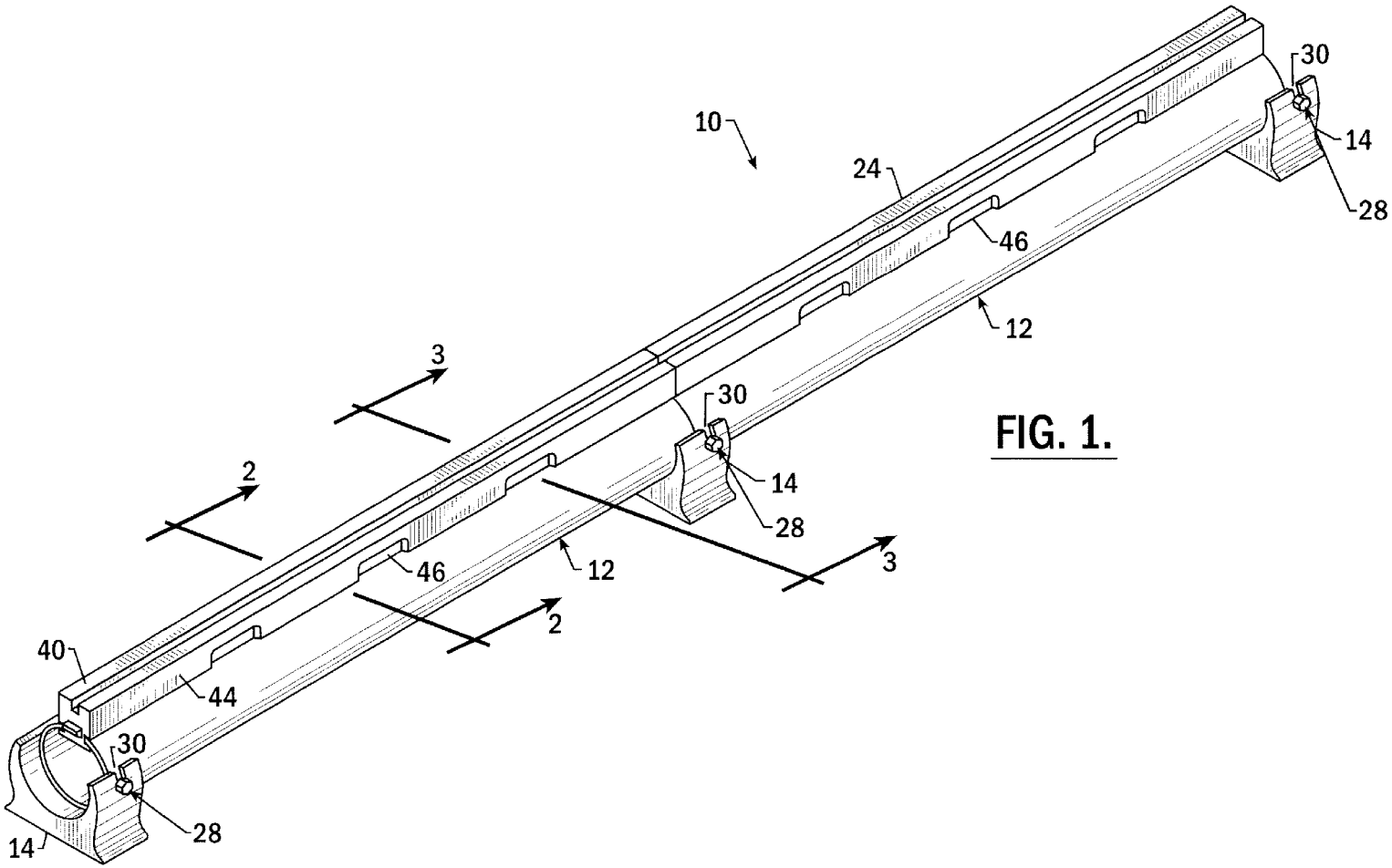
FIG. 1 is a perspective view of a drainage channel according to one embodiment of the present invention.

Referring now to FIG. 1, a drainage channel 10 according to one embodiment of the present invention is illustrated. As shown, the drainage channel includes a conduit 12. The conduit is typically formed of PVC, but may be formed of other thermoformable or thermosetting polymers or from cast or formed metals such as stainless steel sheet. Further, the conduit may be precast from various cementitious materials, such as polyester concrete, a concrete aggregate material containing coarse and inert mineral fillers bonded with polyester resin. Although the conduit is depicted to have a generally circular shape in lateral cross-section, the conduit may have other shapes if so desired. The conduit is generally formed of a number of conduit sections arranged end to end in a lengthwise direction. In order to transport fluid through the conduit, the ends of adjacent conduit sections are generally aligned with and abutted to one another. While the channel sections may come in any length(s) that are desired, the channel sections generally have a common length, such as about one meter.

The conduit 12 is generally supported by at least one and, more typically, a plurality of saddles 14 spaced along the length of the conduit. For example, the plurality of saddles are typically spaced at relatively equal increments along the length of the conduit. In the typical embodiment in which the conduit is formed of a plurality of conduit sections, the saddles are advantageously positioned proximate the ends of the channel sections such that a single saddle can support the ends of two adjacent channel sections in an aligned and an abutting relationship to one another. Moreover, for those saddles that are proximate an end of an entire run of conduit, as opposed to an end of a conduit section that adjoins another conduit section, the saddle is generally positioned to be flush with the end of the conduit. The saddles may also be formed of a thermoformable or thermosetting polymer, such as PVC. Alternatively, the saddles may be formed of other materials, such as various cementitious materials including polyester concrete.

Figure 2:
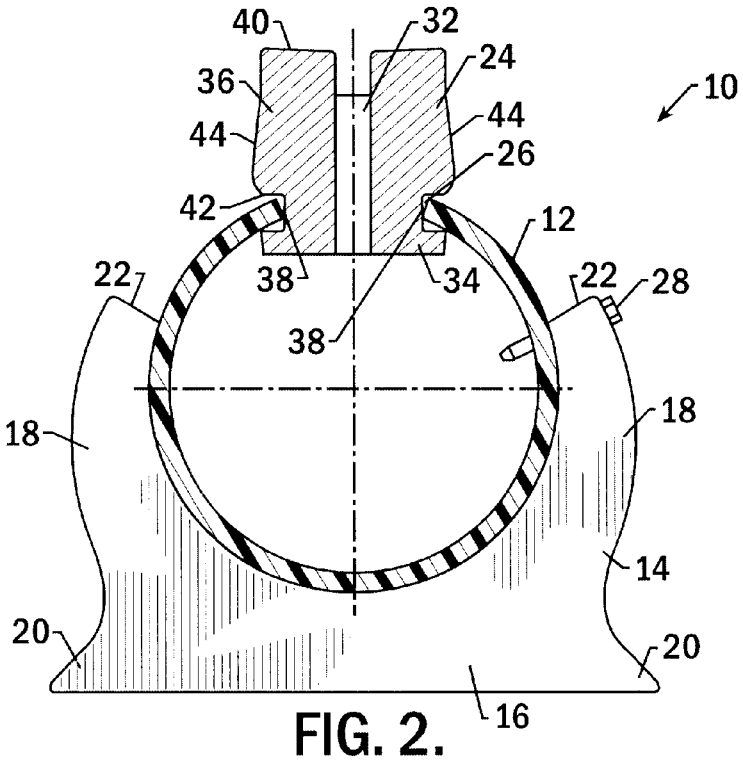
FIG. 2 is a cross-sectional view taken along line 2—2 of FIG. 1 illustrating the pockets defined by the inlet.
Figure 3:
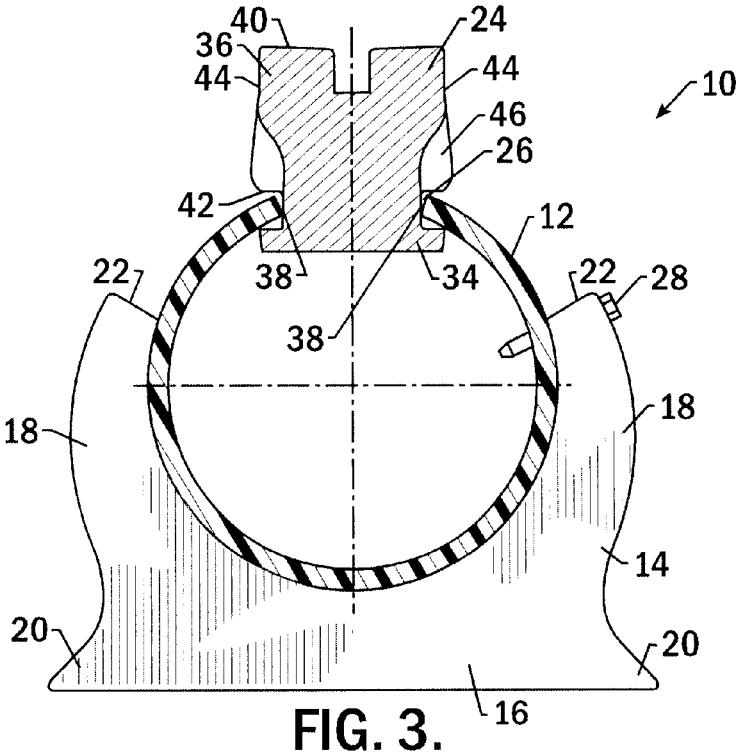
FIG. 3 is a cross-sectional view taken along line 3—3 of FIG. 1 illustrating a passageway defined by the inlet.

The saddles 14 generally include a base 16 for supporting the conduit 12 and a pair of upstanding arms 18 extending outwardly from the base about opposite sides of the conduit. As described hereinafter, the saddle and, more particularly, the base of the saddle is generally positioned upon the floor of the trench or the like during the installation of the drainage channel 10. As shown in FIGS. 2 and 3, the base 16 of the saddle 14 may include feet 20 that extend outwardly, i.e., laterally, from opposite sides of the saddle. The feet effectively broaden the base of the saddle to thereby increase the stability of the saddle. As described below, the feet may also be secured within a subslab or footing of concrete, cement or another hardenable composition (hereinafter generically referred to as a hardenable composition) in order to secure that saddle in position within a ditch or the like.

With respect to the upstanding arms 18, the arms are advantageously positioned and shaped so as to snugly receive the conduit 12. In the embodiment in which the conduit is a cylindrical pipe, for example, those portions of the saddle 14 that contact the cylindrical pipe including the interior surfaces of the upstanding arms generally have an arcuate shape that effectively matches the cylindrical shape of the exterior surface of the pipe.

According to one aspect of the present invention, the saddle 14 advantageously extends about a majority of the conduit 12. As shown in FIGS. 2 and 3 in conjunction with a cylindrical pipe, the saddle, including the upstanding arms 18, extends about more than 180° of the pipe. While the upstanding arms may extend about the majority of the conduit in varying degrees, the upstanding arms generally extend about two-thirds of the conduit.

As a result of the generally arcuate shape of the upstanding arms 18 and the extension of those arms about the majority of the conduit 12, the distal ends 22 of the upstanding arms converge. In this regard, the opening defined between the distal ends of the upstanding arms is generally smaller than the opening defined by medial portions of the upstanding arms. Moreover, in instances in which the conduit is a pipe, the opening defined between the distal ends of the upstanding arms is smaller than the diameter of the pipe. As such, the conduit must be inserted into the saddle 14 in an axial or lengthwise direction as opposed to being placed into the saddle from above. Once the conduit has been seated within the saddle, the saddle and, in particular, the converging distal ends of the upstanding arms prevent the conduit from being lifted or from floating upwardly relative to the saddle. As described below, by securing the saddle in position within a ditch or the like and inserting the conduit within the saddle, a hardenable composition may be poured about the conduit with the saddle preventing the conduit from floating upwardly as a result of buoyant forces exerted by the hardenable composition upon the conduit.

The drainage channel 10 also includes an inlet 24 for receiving rainwater and other fluids from the surrounding surface and for directing those fluids into the conduit 12. In this regard, the conduit generally defines a lengthwise extending opening 26, such as a slot. While the opening typically extends from one end of the conduit to the other, the opening may extend intermittently along the conduit or along only one portion of the conduit without departing from the spirit and scope of the present invention. The opening is generally defined by that portion of the conduit that is opposite the portion of the conduit that faces and is directly supported by the saddle 14. In the illustrated embodiment in which the saddle supports the lowermost portion of the conduit, for example, the opening is generally defined by the uppermost portion of the conduit.

The drainage channel 10 also advantageously includes an engagement member 28 for preventing relative rotation between the conduit 12 and the saddle 14. The drainage channel may include various types of engagement members, but in one embodiment, the engagement member is a threaded member that extends through and engages both the saddle and the conduit. For example, the engagement member may be a drywall screw that extends through the saddle and threadably engages the conduit. To facilitate insertion of the engagement member, the saddle may define a slot 30, a hole or other opening through which the threaded member extends. As shown, the slot is defined proximate the distal end 22 of a respective upstanding arm 18 such that the engagement member extends into the upper half of the conduit. As such, even though the engagement member extends into the conduit, the engagement member will be unlikely to significantly disturb the fluid flowing therethrough as a result of its placement in the upper half of the conduit.

The inlet 24 defines at least one and, more typically, a plurality of passageways 32 that are spaced apart along the length of the inlet. The inlet is therefore positioned with respect to the conduit 12 such that each passageway is in fluid communication with the opening 26 defined by the conduit. As such, fluid entering the passageways defined by the inlet will enter the conduit and be transported therethrough, such as to an underwater storm sewer or the like. The inlet generally engages the conduit and is seated within the opening. In this regard, the inlet of one advantageous embodiment includes a base 34 and a body portion 36 connected to the base. In this embodiment, the inlet is mounted to the conduit such that the base is disposed within the conduit and the body portion is disposed exterior to the conduit. As shown in FIGS. 2 and 3, the inlet generally defines a lengthwise extending groove 38 between the base and the body portion along each side of the inlet. These grooves are sized to receive the edges of the conduit that define the lengthwise extending opening. Thus, the opposed edges of the conduit can engage the corresponding grooves defined by the inlet and secure the inlet within the opening defined by the conduit.

The inlet 24 extends lengthwise along the conduit 12. While the inlet may be continuous along the length of the conduit, the inlet may also be formed of a plurality of inlet sections that are arranged lengthwise in an end-to-end manner. In this embodiment, the inlet sections may have any desired length, but in the illustrated embodiment, the inlet sections have the same length, such as one meter, as the conduit sections. In order to facilitate the alignment and continuity of the inlet sections of this embodiment, the end surfaces of the inlet sections preferably include a male/female connection. In this regard, one end of the inlet section may have a protruding member, while the other end of the inlet section may have a corresponding recess. By appropriately engaging the protrusion of one inlet section with the recess defined by another inlet section, the inlet sections may be aligned.

The inlet 24 may be formed of a variety of materials. Since the inlet will generally be exposed and therefore must be sufficiently durable to withstand the forces that will be applied thereto, the inlet of one embodiment is formed of polyester concrete. However, the inlet may be formed of other materials including a thermoformable or thermosetting polymer, other cementitious materials or cast or formed metals, to name a few.

The body portion 36 of the inlet 24 generally includes an upper surface 40 and an opposed lower surface 42. The upper surface will generally be exposed following the installation of the drainage channel 10 as described below. In order to facilitate the collection of fluids, the upper surface typically has a slight slope such that a medial portion of the upper surface through which the passageways 32 open is slightly recessed relative to outer portions of the upper surface. The body portion also generally includes a pair of opposed side surfaces 44 extending between the upper and lower surfaces. Although these side surfaces may have various configurations, the body portion of one embodiment of the inlet is wider proximate the lower surface then proximate the upper surface. As such, the side surfaces of the body portion of the inlet of this embodiment may taper outwardly proximate the lower surface of the body portion. While the side surfaces may taper outwardly in a linear manner, the inlet of the illustrated embodiment includes a body portion in which upper portions of the side surfaces extend parallel to one another, while lower portions of the side surfaces taper outwardly somewhat. As explained below in conjunction with the installation of a drainage channel of the present invention, an inlet having a body portion with a greater width proximate the lower surface than the upper surface facilitates the retention of the inlet and resists floating of the inlet as a hardenable composition is poured thereabout.

According to one aspect of the present invention, the inlet 24 and, most typically, the body portion 36 of the inlet defines a plurality of pockets 46 spaced apart in the lengthwise direction. The plurality of pockets generally open through at least one of the side and lower surfaces of the body portion and, in the illustrated embodiment, open through both the side and lower surfaces of the body portion.

The plurality of pockets 46 are spaced along the length of the inlet 24 and, as such, do not define a continuous groove or the like that would extend lengthwise along the inlet. By being spaced apart from one another, the pockets advantageously do not significantly adversely affect the strength and integrity of the inlet. While the pockets are shown to be spaced at equal intervals along the length of the conduit, the pockets may be spaced at other uneven intervals if so desired. Typically, the inlet defines pockets in each of the opposed side surfaces 44 of the body portion. The pockets on the opposite sides of the inlet may be aligned with one another as in the illustrated embodiment, or may be staggered or otherwise offset from one another, if so desired. As also shown in the illustrated embodiment, the passageways 32 defined by the inlet may be spaced apart in the lengthwise direction. In this embodiment, the passageways and the pockets are generally offset from one another in the lengthwise direction as shown in FIGS. 2 and 3 to further strengthen the inlet.

The plurality of pockets 46 may be sized differently depending upon the application. Typically, however, the pockets are sized so as to be grasped by a person who is carrying the drainage channel 10. Moreover, while the inlet of the illustrated embodiment includes a plurality of pockets that all are equally sized, the pockets may be differently sized if so desired.

As described below in conjunction with the formation of a drainage channel 10, the pockets 46 receive the hardenable composition that is poured about the drainage channel. As such, the hardenable composition that fills the pockets secures the drainage channel in position. In addition, the hardenable composition supports at least some of the loads that are placed upon the inlet 24, such as by vehicular traffic passing over the drainage channel. In this regard, the hardenable composition that fills the pockets assists in transferring at least some of the loads placed upon the inlet to the hardenable composition that surrounds the drainage channel and therefore at least partially protects the drainage channel and, in particular, the inlet from damage otherwise potentially occasioned by excessive force being placed upon the inlet.

In determining the desired size of the pockets 46, the advantages provided by permitting the hardenable composition to fill the pockets is generally balanced against any loss in strength or integrity of the inlet 24 as a result of the removal of material from the inlet to define the pockets. In one advantageous embodiment in which the body portion 36 of the inlet has a height as defined between the upper and lower surfaces, the plurality of pockets are defined so as to extend upwardly from the lower surface of the body portion through no more than about 50% of the height of the body portion. Similarly, for an inlet having a body portion that defines a width between the opposed side surfaces 44, the plurality of pockets advantageously extend inwardly from a respective side surface of the body portion to a depth that is less than 25% of the width of the body portion. Accordingly, in the embodiment in which pockets are defined on the opposite sides of the inlet in an aligned relationship, the collective depth of a pair of aligned pockets is less than 50% of the width of the body portion. Additionally, the collective length of the pockets is generally less than 50% of the length of the conduit and, in some embodiments, is significantly less than 50% of the length of the conduit. For example, in the embodiment in which the inlet is formed of inlet sections having a length of one meter, the inlet may define three pockets in each side surface of the body portion, with each pocket having a respective length of 2.5 to 3 inches such that collective length of the three pockets is no more than 9 inches, i.e., less than 25% of the total length of the inlet section. By sizing the pockets as described, the inlet may define a plurality of pockets, while still retaining significant strength and integrity to support the loads anticipated following installation of the drainage channel 10.

Figure 4:
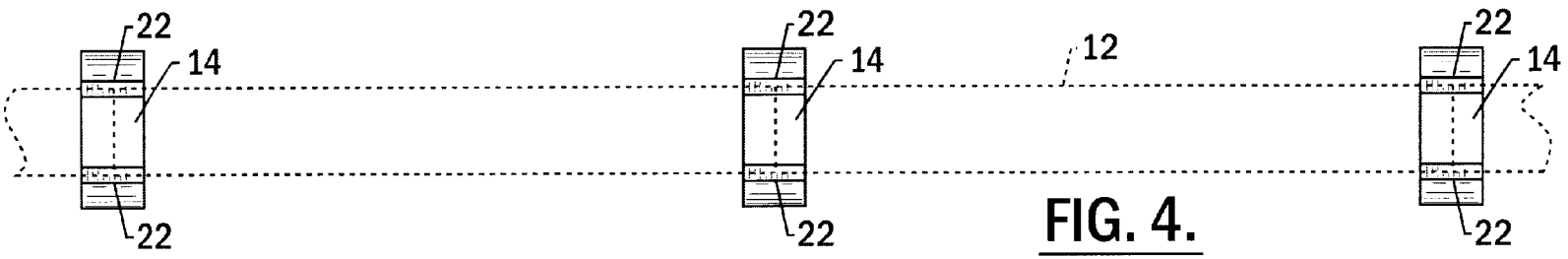
FIG. 4 is a top view illustrating the positioning of a plurality of saddles within a trench.

Although some of the advantages of the drainage channel 10 of the present invention have been set forth above, the installation of a drainage channel of one embodiment of the present invention will be hereinafter described in order to more fully illustrate these advantages. Initially, the surface upon which the drainage channel is to be formed is prepared, such as by digging a trench or otherwise leveling a support surface. As shown in FIG. 4, the saddles 14 are then placed at various locations upon the surface. Since the saddles provide the foundation upon which the remainder of the drainage channel is supported, the saddles are carefully positioned so that the conduit supported by the saddles will have a desired slope, if any, and such that the upper surface 40 of the inlet 24 will be at the desired elevation, preferably flush with the surrounding surface. The saddles may be aligned in various manners known to those skilled in the art, including with conventional laser alignment systems. In addition to this alignment, the saddles may be spaced apart in a predetermined manner; commonly, although not necessarily, with even spacing therebetween. In the embodiment in which the conduit 12 includes a number of conduit sections, for example, the saddles are advantageously positioned proximate the ends of the channel sections such that a single saddle supports the abutting ends of two adjacent channel sections as indicated with dashed lines in FIG. 4.

Figure 5:
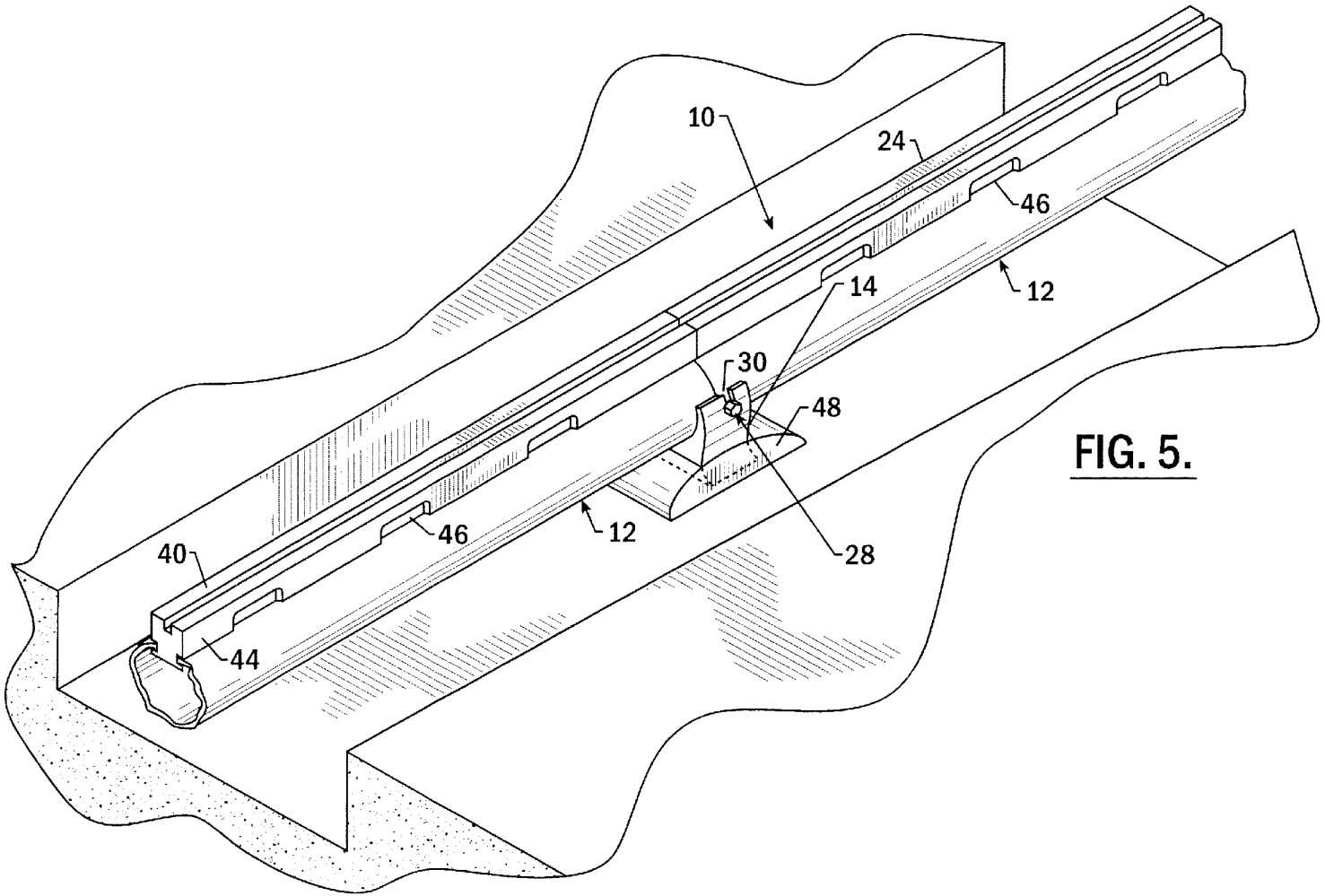
FIG. 5 is a perspective view illustrating the placement of the conduit and the inlet upon the saddles within the trench.

Once the saddles 14 have been appropriately positioned, a hardenable composition (designated 48 in FIG. 4) is poured or placed about the base 16 of the saddle and, in particular, about the feet 20 of the saddles. Once this hardenable composition has set, the saddles are fixed in position. Either prior to or after pouring the hardenable composition about the base of the saddles, the conduit 12 may be inserted into the saddles so as to be supported thereby. In instances in which the conduit is formed of a plurality of conduit sections, the conduit sections are positioned such that the ends of the conduit sections abut one another and are supported by the saddles. Although not necessary for the practice of the present invention, the abutting ends of the conduit sections may also be connected by means of tape, such as duct tape, glue or the like. The conduit is also positioned relative to the saddles such that the opening 26, or the inlet 24 if the inlet has already been mounted to the conduit, faces in the desired direction, generally in an upward direction. Thereafter, the engagement members 28 are inserted so as to mechanically connect the saddles to the conduit and to prevent relative rotation therebetween. In one embodiment, holes are drilled through the conduit at locations coincident with the slots 30 defined by the saddles. As such, an engagement member may be inserted through the slot defined by a respective saddle and then threadably advanced through the hole drilled in the conduit. If the inlet has not already been mounted to the conduit, such as prior to its insertion into the saddles, the inlet may then be mounted to the conduit so as to be seated within the opening defined thereby. See, for example, FIG. 5.

Figure 6:
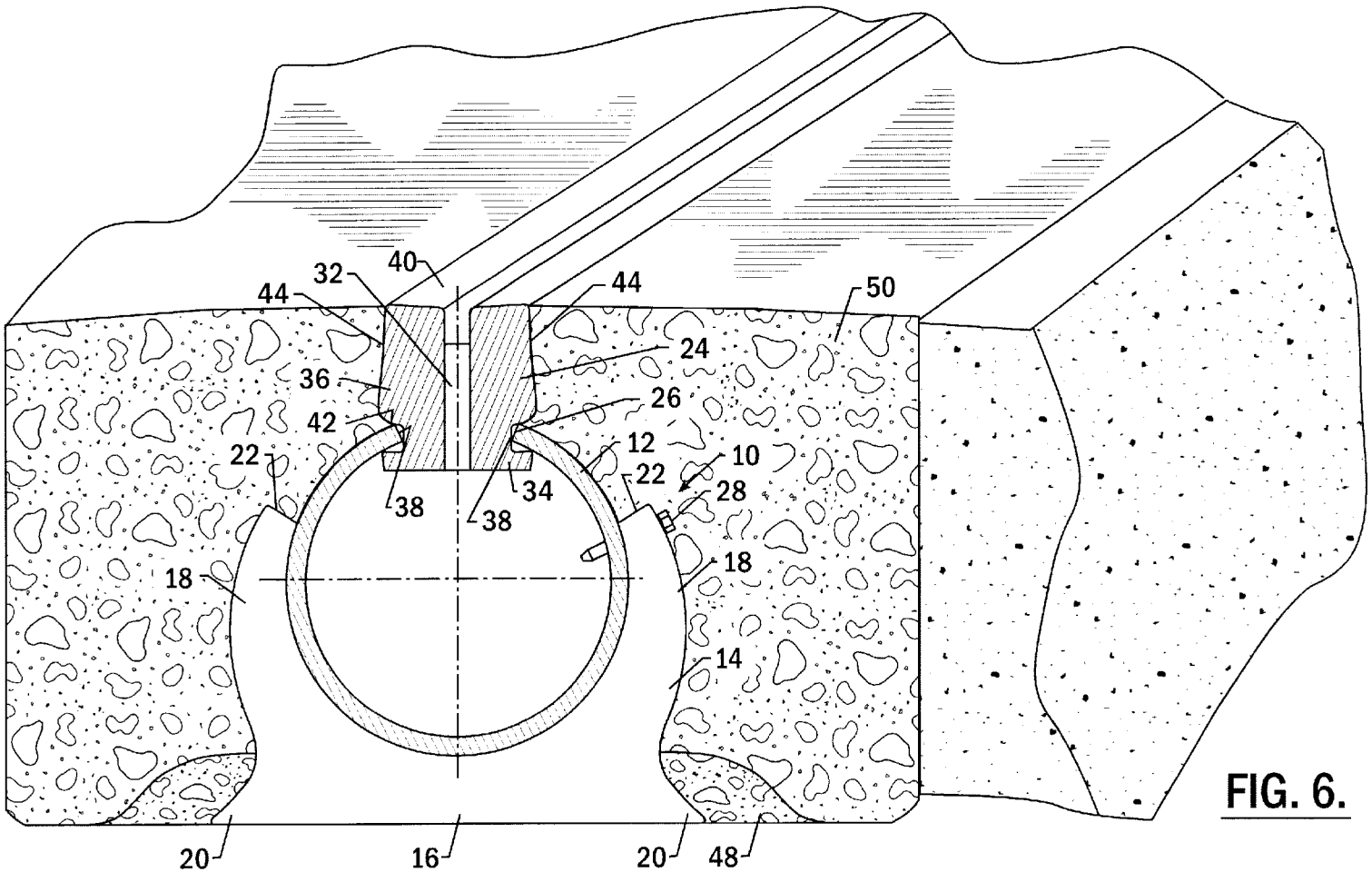
FIG. 6 is a perspective view illustrating the inlet and the surrounding surface after concrete or another hardenable composition has filled the trench around the drainage channel.

Once the drainage channel 10 has been assembled, a hardenable composition 50 may be poured about the drainage channel to a desired level. In this regard, the hardenable composition may be poured about the drainage channel to a level flush with the upper surface 40 of the inlet 24 as shown in FIG. 6. In other embodiments, however, the cementitious material is poured about the drainage channel to a predetermined level below the upper surface of the inlet. In this embodiment, another material, such as asphalt, a polymeric running surface, an artificial turf surface or any combination of these or other materials, may be placed upon the hardenable material to complete the installation. In any event, the surrounding surface is generally flush with the upper surface of the inlet to permit rainwater or other fluids to drain from the surrounding surface into the passageways 32 defined by the inlet and, in turn, into the conduit 12 which may transport the fluid to an underwater storm sewer or the like.

As a result of the construction of the drainage channel 10, the drainage channel remains securely in position as the hardenable composition is poured thereabout. In this regard, the extension of the saddle 14 and, in particular, the upstanding arms 18 about a majority of the conduit 12 and the convergence of the distal ends 20 of the upstanding arms prevents the conduit from floating upwardly away from the saddles as the hardenable composition is poured thereabout. In addition, the engagement member 28 prevents the conduit from disadvantageously rotating with respect to the saddle and misaligning the opening 26 defined thereby. Additionally, the plurality of pockets 46 defined by the inlet are filled with the hardenable composition and further secure the drainage channel to the hardenable composition. As described above, hardenable composition that fills the plurality of pockets also helps to support at least some of the forces placed upon the inlet, such as from vehicular traffic or the like. Moreover, the plurality of pockets may also serve as hand holds during manual transportation of the inlet and, in some embodiments, the combination of the inlet and the conduit to the installation site.

Although not necessary for the present invention, the conduit 12 may be disposed in fluid communication with and may empty into a catch basin. As known to those skilled in the art, a catch basin provides an inline container for collecting large or relatively heavy objects and for preventing those objects from otherwise blocking the conduit. The catch basin therefore includes a cover, such as a grate, that may be removed in order to access and remove these objects periodically.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A drainage channel comprising:

a conduit defining a lengthwise extending opening; and an inlet defining a passageway in fluid communication with the opening defined by said conduit, said inlet having an exterior surface that defines a plurality of pockets spaced apart in the lengthwise direction, wherein said inlet is comprised of a solid material having a thickness in a lateral direction, orthogonal to the lengthwise direction, that is less proximate a respective pocket than proximate other portions of said inlet.

2. A drainage channel according to claim 1 wherein said inlet comprises a base and a body portion connected thereto and defining the plurality of pockets.

3. A drainage channel according to claim 2 wherein said body portion comprises opposed upper and lower surfaces and a side surface extending therebetween, and wherein the plurality of pockets open through at least one of the side and lower surfaces of said body portion.

4. A drainage channel according to claim 3 wherein the plurality of pockets open through both the side and lower surfaces of said body portion.

5. A drainage channel according to claim 3 wherein said body portion has a height as defined between the upper and lower surfaces, and wherein the plurality of pockets extend upwardly from the lower surface of said body portion through no more than about 50% of the height of said body portion.

6. A drainage channel according to claim 3 wherein said body portion further comprises a pair of opposed side surfaces extending between the upper and lower surfaces and defining a width therebetween, and wherein the plurality of pockets extend inwardly from a respective side surface of said body portion to depth that is less than 25% of the width of said body portion.

7. A drainage channel according to claim 2 wherein said body portion comprises opposed upper and lower surfaces, and wherein said body portion is wider proximate the lower surface than proximate the upper surface.

8. A drainage channel according to claim 1 wherein said conduit has a length, and wherein the plurality of pockets have a collective length in the lengthwise direction that is less than 50% of the length of said conduit.

9. A drainage channel according to claim 1 wherein said conduit and said inlet have respective widths in the lateral direction orthogonal to the lengthwise direction, and wherein the width of said inlet is smaller than the width of said conduit.

10. A drainage channel according to claim 1 wherein said inlet engages said conduit and is seated within the opening.

11. A drainage channel according to claim 10 wherein said inlet comprises a base and a body portion connected thereto, wherein said base is disposed within said conduit and said body portion is disposed external to said conduit.

12. A drainage channel according to claim 1 wherein said conduit comprises a pipe defining the lengthwise extending opening.

13. A drainage channel comprising:

a conduit defining a lengthwise extending opening; and an inlet engaging said conduit and being seated within the opening such that a passageway defined by said inlet is in fluid communication with the opening, said inlet comprising a base disposed within said conduit and a body portion connected to said base and disposed external to said conduit, said body portion having an exterior surface that comprises opposed upper and lower surfaces and a side surface extending therebetween, wherein the exterior surface of said body portion defines a plurality of pockets spaced apart in the lengthwise direction and opening through both the side and lower surfaces of said body portion, wherein said conduit and said inlet have respective widths in a lateral direction orthogonal to the lengthwise direction, and wherein the width of said inlet is smaller than the width of said conduit.

14. A drainage channel according to claim 13 wherein said body portion has a height as defined between the upper and lower surfaces, and wherein the plurality of pockets extend upwardly from the lower surface of said body portion through more than 50% of the height of said body portion.

15. A drainage channel according to claim 13 wherein said body portion further comprises a pair of opposed side surfaces extending between the upper and lower surfaces and defining a width therebetween, and wherein the plurality of pockets extend inwardly from a respective side surface of said body portion to depth that is less than 25% of the width of said body portion.

16. A drainage channel according to claim 13 wherein said body portion comprises opposed upper and lower surfaces, and wherein said body portion is wider proximate the lower surface than proximate the upper surface.

17. A drainage channel according to claim 13 wherein said conduit has a length, and wherein the plurality of pockets have a collective length in the lengthwise direction that is less than 50% of the length of said conduit.

18. A drainage channel comprising:

a conduit;

at least one saddle for supporting said conduit, said at least one saddle extending about a majority of said conduit; and an engagement member for preventing relative rotation between said conduit and said at least one saddle.

19. A drainage channel according to claim 18 wherein said saddle comprises a pair of upstanding arms disposed on opposite sides of said conduit.

20. A drainage channel according to claim 18 wherein said saddle further comprises a base, and wherein said arms extend outwardly from said base to respective distal ends.

21. A drainage channel according to claim 20 wherein the distal ends of said arms converge such that an opening defined between the distal ends of said arms is smaller than the opening defined between medial portions of said arms.

22. A drainage channel according to claim 18 wherein said conduit comprises a pipe having a smooth exterior surface.

23. A drainage channel according to claim 18 wherein said conduit comprises a pipe having a corrugated exterior surface.

24. A drainage channel according to claim 18 wherein said engagement member comprises a threaded member that extends through said saddle and into said conduit.

25. A drainage channel according to claim 24 wherein said saddle defines a slot through which said threaded member extends.

26. A drainage channel according to claim 18 wherein said conduit comprises a plurality of conduit sections, and wherein said saddle is positioned to support end portions of two adjacent conduit sections.

27. A drainage channel according to claim 18 wherein said conduit defines a lengthwise extending opening, and wherein the drainage channel further comprises an inlet defining a passageway in fluid communication with the opening defined by said conduit.

28. A drainage channel according to claim 18 wherein said saddle comprises at least one outwardly extending foot.

29. A drainage channel comprising:

a conduit defining a lengthwise extending opening;

an inlet defining a passageway in fluid communication with the opening defined by said conduit;

at least one saddle for supporting said conduit, said at least one saddle comprising a base and a pair of arms extending outwardly from said base to respective distal ends, said arms disposed on opposite sides of said conduit so as to collectively extend about a majority of said conduit, wherein the distal ends of said arms converge such that an opening defined between the distal ends of said arms is smaller than the opening defined between medial portions of said arms; and an engagement member for preventing relative rotation between said conduit and said at least one saddle.

30. A drainage channel according to claim 29 wherein said conduit comprises a pipe having a smooth exterior surface.

31. A drainage channel according to claim 29 wherein said conduit comprises a pipe having a corrugated exterior surface.

32. A drainage channel according to claim 29 wherein said engagement member comprises a threaded member that extends through said saddle and into said conduit.

* * * * *